US008389837B1

(12) United States Patent
Leguía

(10) Patent No.: US 8,389,837 B1
(45) Date of Patent: Mar. 5, 2013

(54) STRINGED INSTRUMENT HAVING A FRETBOARD CANTILEVERED OVER THE SOUNDBOARD

(75) Inventor: Luis G. Leguía, Milton, MA (US)

(73) Assignee: Luis and Clark, Inc., Milton, OH (US)

( * ) Notice: Subject to any disclaimer, the term of this patent is extended or adjusted under 35 U.S.C. 154(b) by 88 days.

(21) Appl. No.: 12/803,230

(22) Filed: Jun. 21, 2010

(51) Int. Cl.
*G10D 3/04* (2006.01)

(52) U.S. Cl. ..... 84/314 R; 84/267

(58) Field of Classification Search ..... 84/314 R
See application file for complete search history.

(56) References Cited

U.S. PATENT DOCUMENTS

| | | | | |
|---|---|---|---|---|
| 3,699,836 | A | 10/1972 | Glasser | |
| 3,962,946 | A | 6/1976 | Rickard | |
| 3,992,972 | A | 11/1976 | Rickard | |
| 4,084,475 | A * | 4/1978 | Horowitz | 84/291 |
| 4,084,476 | A | 4/1978 | Richard | |
| 4,145,948 | A | 3/1979 | Turner | |
| 4,408,516 | A | 10/1983 | John | |
| 4,836,076 | A | 6/1989 | Bernier | |
| 4,873,907 | A | 10/1989 | Decker, Jr. et al. | |
| 4,955,274 | A | 9/1990 | Stephens | |
| 4,969,381 | A | 11/1990 | Decker, Jr. et al. | |
| 5,895,872 | A * | 4/1999 | Chase | 84/291 |
| 5,952,592 | A | 9/1999 | Teel | |
| 5,955,688 | A | 9/1999 | Cook | |
| 6,034,309 | A | 3/2000 | Teel et al. | |
| 6,087,568 | A | 7/2000 | Seal | |
| 6,107,552 | A | 8/2000 | Coomar et al. | |
| 6,420,638 | B2 | 7/2002 | Teel | |
| 6,605,766 | B2 | 8/2003 | Teel | |
| 6,664,452 | B1 | 12/2003 | Teel | |
| 6,965,065 | B2 | 11/2005 | McPherson | |
| 2008/0190264 | A1 * | 8/2008 | Jones et al. | 84/314 R |

OTHER PUBLICATIONS

Brune, R. E., Eight Concerns of Highly Successful Guitar Makers, Proceedings of the GAL Convention, 2001.

* cited by examiner

*Primary Examiner* — Christopher Uhlir
(74) *Attorney, Agent, or Firm* — Christine M. Kuta

(57) ABSTRACT

A composite fretboard has a tapered form and a cantilevered end. A guitar constructed with the fretboard is able to maintain certain elements of classical guitar form with a soundboard able to vibrate freely producing an improved sound quality.

8 Claims, 5 Drawing Sheets

STRINGED INSTRUMENT HAVING A FRETBOARD CANTILEVERED OVER THE SOUNDBOARD

BACKGROUND

In a hollow-body acoustic guitar, the musical tones produced by the strings are intensified and enriched by the supplementary vibration induced in the guitar body including the top, also referred to as the soundboard. Accordingly, it is desirable that the guitar be constructed such that the soundboard is able to vibrate as freely as possible.

Further, it is desirable that the guitar construction have the necessary strength to support the forces exerted by the taut strings on the neck and body. The strings transmit sound vibrations to the soundboard through a bridge mounted to the front face of the soundboard over which the strings are tightly strung. To compensate for the tension forces produced by the strings, conventional guitars generally include a significant amount of structural reinforcement, e.g., various configurations of braces in and on the guitar body and tension bars in the neck. These reinforcements add considerably to the manufacturing cost and weight of the instrument and are known to affect the tone of the instrument. Accordingly, in the construction of conventional instruments some compromise is generally made, and structural integrity is attained in some instrument designs at some sacrifice to the instrument's acoustical performance. In some cases, the compromise is such that the instrument deviates from an accepted classical form so that, while the instrument produces an adequate sound, the instrument design may be uncomfortable for the musician.

Conventional guitars typically include a support structure in and/or on the body of the guitar for the fretboard. In some guitars, the fretboard is supported by a support structure between the soundboard and the fretboard. The support structure in these conventional designs tends to dampen the action of the soundboard. In some guitars, the fretboard is supported by the soundboard itself and is joined to the soundboard, for example, by glue. As described above, the tension of the strings tends to cause the guitar to bend toward the strings. In those guitars where the fretboard is glued to the soundboard, this tension can cause the fretboard to press down on the soundboard and deform it which affects the sound quality and playability of the instrument.

Conventional art attempts to improve sound quality and the structural integrity of the guitar have included exploring various alternative soundboard designs and the use of various construction schema using wood and composite materials. There remains, however, a need for a guitar assembly that provides improved sound quality with minimal structural reinforcement.

SUMMARY

The present invention is directed to a hollow-body guitar having an improved cantilevered fretboard that enables the guitar soundboard to vibrate freely thereby providing improved sound quality, the fretboard being further shaped and configured such that the guitar conforms to certain elements of a classical design.

In one embodiment, a guitar having a body and a neck constructed from composite materials further includes a composite fretboard. An example composite material suitable for such a guitar construction is a carbon fiber matrix. The fretboard is formed and configured to cantilever over the soundboard without any support structure resting on top of the soundboard. The soundboard is thereby able to vibrate more freely. The fretboard further is tapered such that it provides structure to the neck of the guitar enabling the guitar to conform to established classical design with minimal weight and deformation under string tension.

The present invention together with the above and other advantages may best be understood from the following detailed description of the embodiments of the invention illustrated in the drawings, wherein:

DRAWINGS

DESCRIPTION

A hollow body acoustic guitar largely constructed from composite materials further includes a tapered and cantilevered composite fretboard.

The term guitar refers to a musical instrument of the chordophone family, being a stringed instrument played by plucking, either with fingers or a pick. The guitar embodiments in the present invention are hollow body acoustic guitars of the type generally known as classical guitars.

The term "composite material" means a material composition made chiefly of two or more materials, such as carbon fibers embedded in an epoxy resin matrix with the fibers either being arranged randomly, unidirectionally or woven into a fabric. The combination of the two or more materials (reinforcing elements, fillers, and composite matrix binder), differ in form or composition on a macroscale. The constituent materials retain their identities, that is, they do not dissolve or merge completely into one another although they act in concert.

Figure 1:
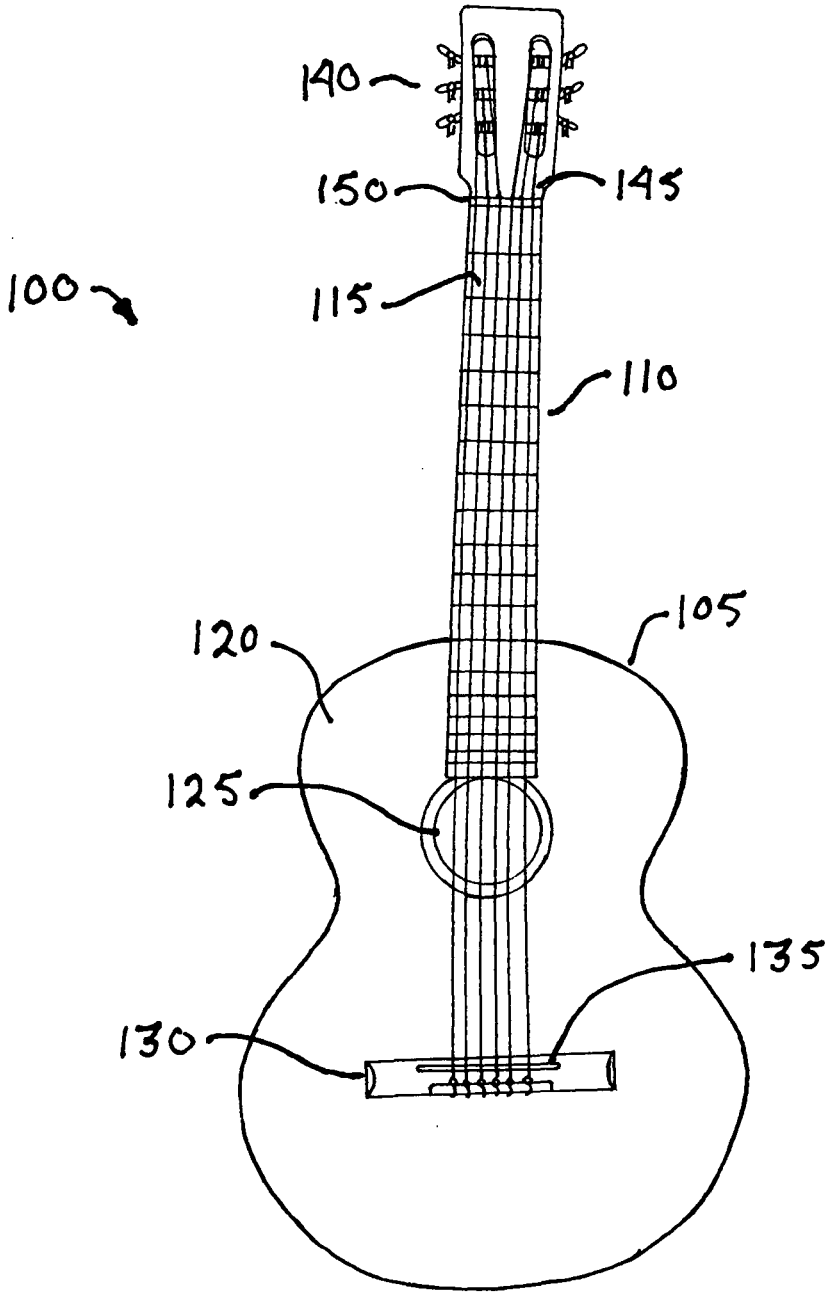
FIG. 1 is a top view of a guitar according to principles of the invention.

FIG. 1 shows a guitar 100 having a hollow body 105 and a neck 110. The body 105 has a soundboard 120 with an aperture referred to as a sound hole 125. A bridge 130 is mounted to the soundboard 120. The bridge 130 includes a saddle 135. The neck 110 has a fretboard 115, also referred to as a fingerboard, and a head stock 140. Strings 145 are attached at first attachment points at the head stock 140, pass over a guide referred to as a "nut" 150, extend along the neck 110 and across the sound hole 125, then over the saddle 135 and attach at second attachment points on the bridge 130. The strings 145 are maintained in a tensioned state between the nut 150 and the saddle 135.

The guitar 100 of the present invention is largely constructed of composite materials. The body 105, neck 110 and fretboard 115 are, for example, constructed from a carbon fiber matrix. The fretboard 115 of the present guitar embodiment takes advantage of the strength of composite materials and has a tapered design to enable a cantilever over the soundboard 120 such that the fretboard 115 is not supported on the soundboard 120. The cantilever ensures that the soundboard 120 is able to vibrate freely without interference from the fretboard 115. Further, the composite structure and the tapered design of the fretboard 115 provide the advantages of lightweight construction while providing stiffness that enables the guitar to conform to certain elements of classical guitar design. This is described in further detail below.

Figure 2:
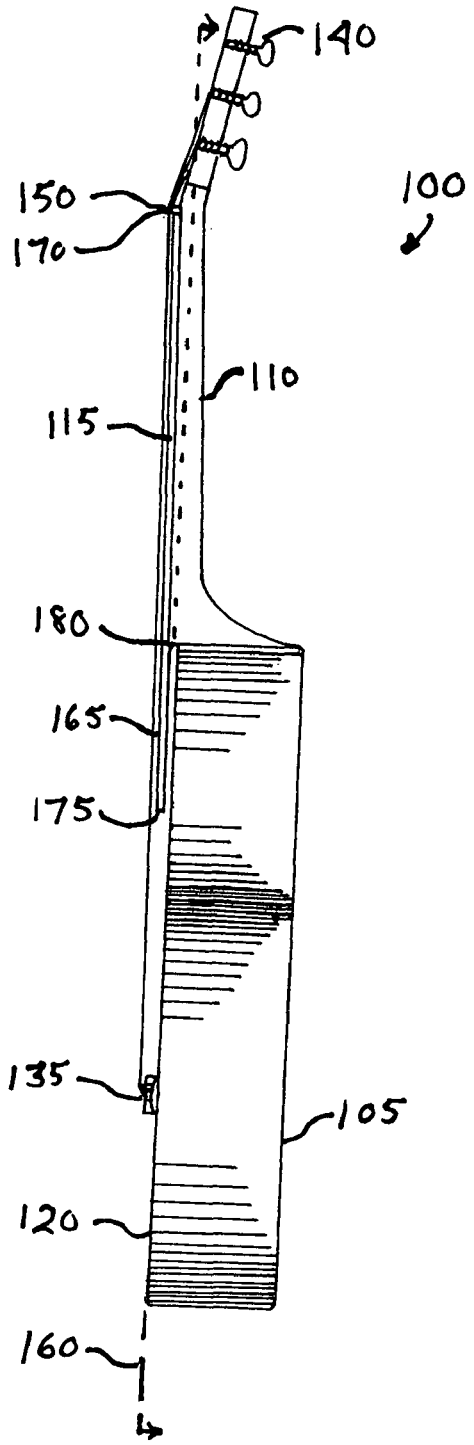
FIG. 2 is a side view of the guitar of FIG. 1.

FIG. 2 is a side view of the guitar of FIG. 1. FIG. 2 shows a guitar 100 having a hollow body 105 and a neck 110 and a head stock 140. The body 105 has a soundboard 120 and a bridge 130. The bridge 130 includes a saddle 135. The neck 110 has a fretboard 115, also referred to as a fingerboard. In one embodiment, the back and sides of the body 105, the neck 110 and the head stock 140 are formed as a single piece using composite materials such as a carbon fiber matrix. The neck 110 is closed off from the body 105. The soundboard 120 is mounted to and forms a cover over the body 105. The fretboard 115 is mounted to and forms a cover over the neck 110.

In established classical guitar form, the neck of the guitar is not coplanar with the soundboard. The neck is typically angled such that the nut end is 2-6 mm above the plane 165 of the soundboard where the soundboard plane is defined by the soundboard at the edge. In other words, the plane defined by the fretboard forms an angle between 0.5 and 4 degrees with the plane defined by the soundboard. This angle enables a lower bridge to be implemented which in turn affects the height of the strings over the soundboard and fretboard. Compromises made in conventional guitar design have included larger and thicker necks and necks having a much larger angle in order to compensate for other design considerations including the design of the bridge. The neck angle shown in FIG. 2 is exaggerated for clarity. Guitars according to embodiments of the present invention are able to conform to the lower-angled classical form.

Returning to FIG. 2, the fretboard 115 has a head end 170 where the headstock 140 meets the neck 110 and a foot end 175 at the sound hole 125 (not visible in this view). The fretboard 115 in the present guitar embodiment has a first taper extending generally from the head end 170 to approximately the area of the twelfth fret. Alternatively, the first taper extends generally to the point 180 where the neck meets the guitar body. The head end 170 of the fretboard is relatively thin, for example 4 mm in thickness. The fretboard 115 is made gradually thicker in the direction of the soundboard where the thickest point is, for example, 6 mm in thickness. A second taper begins at or after the thickest point and extends to the foot end 175 of the fretboard 115. The tapers are described in greater detail below with regard to FIG. 3.

The fretboard 115 further has a cantilever portion 165 over the soundboard 120 such that there is no support structure between the fretboard 115 and the soundboard 120. This enables the soundboard 120 of the present embodiment to vibrate freely. The cantilever is described in greater detail below with regard to FIGS. 3 and 4.

Figure 3:
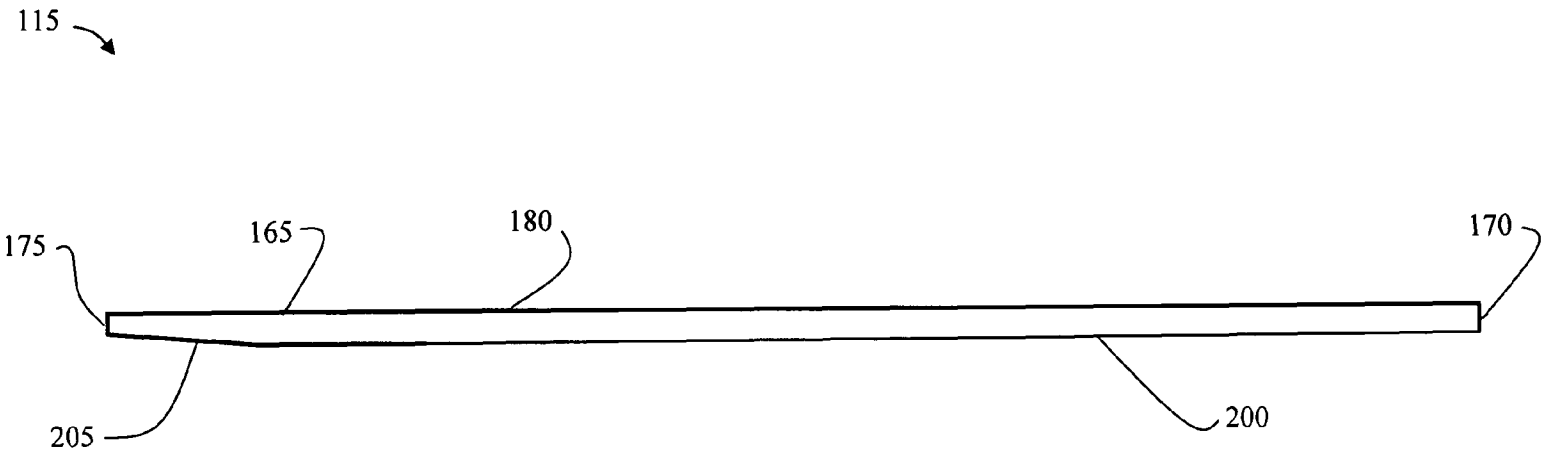
FIG. 3 is a side view of a fretboard of the guitar of FIG. 1.

FIG. 3 is a side view of the fretboard 115. The fretboard 115 has a head end 170 and a foot end 175 and is constructed from composite materials as described above. The fretboard 115 has a first taper 200 extending from the head end 170 to approximately the twelfth fret in one arrangement and, in a second arrangement, approximately to the point where the neck 110 meets the body 105 of the guitar. The thickness of the fretboard 115 at the thickest point of the first taper 200 is, for example, 6 mm. The thickness of the first taper at the thinnest point at the head end 170 is, for example, 4-4.5 mm. The fretboard 115 further has a second taper 205 in the cantilever 165 portion of the fretboard 115. The thickness of the second taper at the foot end 175 is, for example 4-4.5 mm. In a first arrangement, the second taper 205 is approximately 1.5 inches long. In a second arrangement, the second taper 205 extends from the foot end 175 for approximately the length of the cantilever 165.

The force of the strings in tension typically tends to cause stringed instruments to bend in the direction of the strings. The composite construction of the present fretboard 115 provides strength and stability to the present guitar, particularly the neck 110, so that the angle of the neck as described above is maintained even under string tension. The first taper 200 also minimizes the amount of material in the fretboard thereby reducing the overall weight of the guitar. The thickest portion of the fretboard 115 at the point where the neck meets the guitar body enables the fretboard to be cantilevered above the soundboard. The second taper 205 has two functions. First, the second taper 205 provides that adequate space between the soundboard 120 and the fretboard 115 is created and maintained. Second, should the instrument bend forward, the second taper 205 tends to prevent the fretboard 115 from touching the soundboard 120. The fretboard thicknesses provided here are merely exemplary. The present invention is not considered limited by the measurements provided here.

Figure 4:
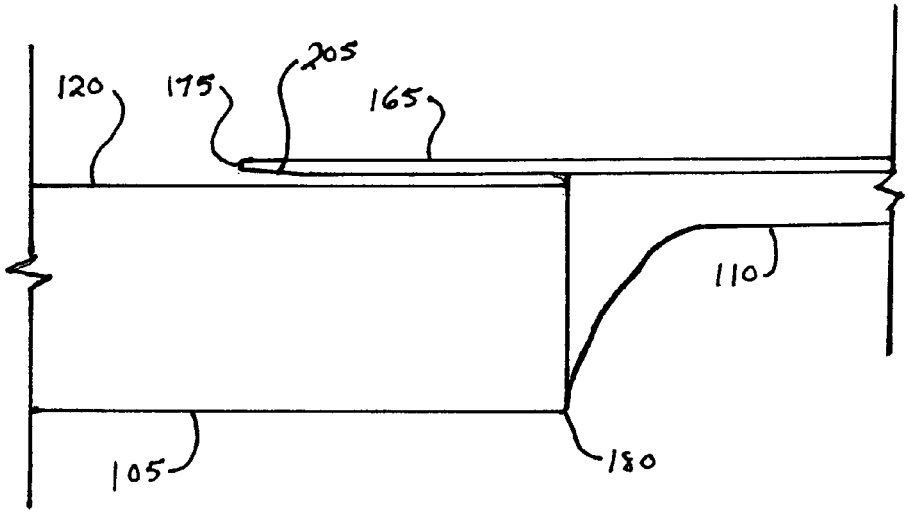
FIG. 4 is a side view of a portion of the guitar of FIG. 1 showing the cantilevered portion of the fretboard.

FIG. 4 is a side view of a portion of the guitar of FIG. 1 showing the cantilevered portion of the fretboard. The fretboard 115 is supported by the neck 110. The neck 110 is closed off from the body 105. The portion of the fretboard 115 over the soundboard 120 forms a cantilever 165 spaced apart from the soundboard 120. The space between the sound board and the foot end 175 of the fretboard is for example 6.3 mm. Accordingly, the fretboard 115 does not touch the soundboard 120 thereby enabling the soundboard 120 to vibrate freely.

Figure 5:
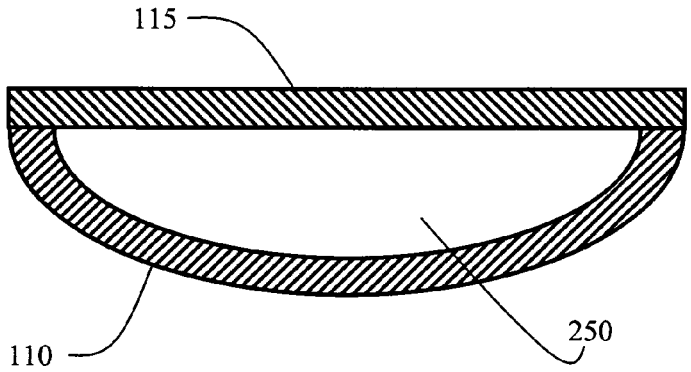
FIG. 5 is a cross-sectional view of the neck of the guitar of FIG. 1.

FIG. 5 is a cross-sectional view of the neck of the guitar of FIG. 1. The neck 110 is hollow having a space 250 below the fretboard 115. The neck 110 is shaped and configured to support the fretboard 115 including accommodation for the first taper of the fretboard and the cantilever. In some embodiments, the fretboard 115 is slightly arched across its width. Typically, the arch is a millimeter in height. Among the reasons for providing such an arch is the comfort of the musician. The arch is typically included near the top 170 of the fretboard 115 through the cantilever 165.

It is to be understood that the above-identified embodiments are simply illustrative of the principles of the invention. Various and other modifications and changes may be made by those skilled in the art which will embody the principles of the invention and fall within the spirit and scope thereof.

What is claimed is:

1. A fretboard for a composite guitar, the composite guitar having a body and a neck, the neck having a head and a foot, the composite guitar including a soundboard, the fretboard comprising:

an elongated member constructed from a composite matrix, the elongated member having a first portion configured to conform to at least one element of classical design, the first portion to be attached to the neck of the composite guitar and having a head end corresponding to the head of the neck and a foot end corresponding to the foot of the neck, the first portion having a taper having a thin end at the head end and increasing in thickness toward the foot end, and a second portion configured to cantilever over the soundboard when the fretboard is mounted on the guitar such that the soundboard provides no support to the fretboard, the second portion having an anchored end where the neck meets the body of the composite guitar and a free end, the second portion further has a taper, the taper of the second portion being thinnest at the free end, and wherein the taper of the second portion extends for 1.5 inches from the free end.

2. The fretboard of claim 1 wherein the at least one element of classical design is an angle defined by the fretboard and the soundboard where the angle is between 0.5 and 4 degrees.

3. The fretboard of claim 1 wherein the taper of the first portion is equivalent in length with the neck of the composite guitar.

4. The fretboard of claim 1 wherein the composite matrix further comprises carbon fiber.

5. A composite guitar, comprising:

a body, a neck and a headstock being integrally formed of a composite matrix, the neck having a head and a foot;

a composite matrix soundboard mounted to the body; and a fretboard formed of a composite matrix, the fretboard having a first portion configured to conform to at least one element of classical design, the first portion being mounted to the neck, the first portion having a head end corresponding to the head of the neck and a foot end corresponding to the foot of the neck, the first portion having a taper having a thin end at the head end and increasing in thickness toward the foot end, and the fretboard having a second portion configured to cantilever over the soundboard when the fretboard is mounted on the guitar such that the soundboard provides no support to the fretboard, the second portion having an anchored end where the neck meets the body of the composite guitar and a free end, the second portion further has a taper, the taper of the second portion being thinnest at the free end of the second portion, and wherein the taper of the second portion extends for 1.5 inches from the free end.

6. The composite guitar of claim 5 wherein the at least one element of classical design is an angle defined by the fretboard and the soundboard where the angle is between 0.5 and 4 degrees.

7. The composite guitar of claim 5 wherein the taper of the first portion is equivalent in length with the neck of the composite guitar.

8. The composite guitar of claim 5 wherein the composite matrix further comprises carbon fiber.

* * * * *